US007458505B2

(12) United States Patent
Majima et al.

(10) Patent No.: US 7,458,505 B2
(45) Date of Patent: Dec. 2, 2008

(54) BORING DEVICE

(75) Inventors: Toshiyuki Majima, Kaga (JP); Kazuo Nishimura, Kaga (JP)

(73) Assignee: Daido Kogyo Co., Ltd., Ishikawa-Ken (JP)

( * ) Notice: Subject to any disclaimer, the term of this patent is extended or adjusted under 35 U.S.C. 154(b) by 255 days.

(21) Appl. No.: 10/532,135

(22) PCT Filed: Oct. 21, 2003

(86) PCT No.: PCT/JP03/13412

§ 371 (c)(1),
(2), (4) Date: Oct. 6, 2005

(87) PCT Pub. No.: WO2004/035274

PCT Pub. Date: Apr. 29, 2004

(65) Prior Publication Data

US 2006/0151590 A1 Jul. 13, 2006

(30) Foreign Application Priority Data

Oct. 21, 2002 (JP) ..... 2002-306361

(51) Int. Cl.
*B26F 1/04* (2006.01)
*B26F 1/14* (2006.01)

(52) U.S. Cl. ..... 234/98; 83/549; 83/687

(58) Field of Classification Search ..... 234/42, 234/43, 94, 97, 98, 101, 106; 83/549, 588, 83/618–620, 622, 628, 629, 638, 687, 821
See application file for complete search history.

(56) References Cited

U.S. PATENT DOCUMENTS 2,034,341 A * 3/1936 Gregory et al. ..... 234/106
2,185,685 A * 1/1940 Blakely ..... 234/94

(Continued)

FOREIGN PATENT DOCUMENTS

EP 1 240 985 A2 9/2002

(Continued)

OTHER PUBLICATIONS

English Translation of First Office Action of Chinese Patent Application No. 2003801018197.

(Continued)

*Primary Examiner*—Jason D Prone
(74) *Attorney, Agent, or Firm*—Wenderoth, Lind & Ponack, L.L.P.

(57) ABSTRACT

A punching unit is arranged so that a plurality of punches is grouped into a first group having a predetermined number of punches and a second group containing any one of the punches in the first group and having a smaller number of punches. A punching state of the predetermined number of punches is produced by reciprocating a reciprocating member within a first range and by vertically moving the punches of the first group through the intermediary of cams and followers corresponding to the first group and another punching state of the smaller number of punches is reached by reciprocating the reciprocating member within a second movable range and vertically moving the punches of the second group through the intermediary of cams and followers corresponding to the second group. This arrangement allows the number of punches and dies to be reduced as compared to the prior art.

5 Claims, 11 Drawing Sheets

U.S. PATENT DOCUMENTS

| | | | | | |
|---|---|---|---|---|---|
| 2,458,160 | A | * | 1/1949 | Grappe | 83/549 |
| 3,334,809 | A | * | 8/1967 | Zajic et al. | 234/106 |
| 3,750,502 | A | * | 8/1973 | Ball | 83/620 |
| 4,480,782 | A | * | 11/1984 | Morishima | 234/98 |
| 4,569,267 | A | * | 2/1986 | Klingel | 83/549 |
| 4,596,359 | A | * | 6/1986 | Nordli | 234/107 |
| 4,898,056 | A | * | 2/1990 | Grobb et al. | 83/622 |
| 5,894,778 | A | * | 4/1999 | Mori | 83/629 |
| 6,374,715 | B1 | | 4/2002 | Takatsuka | |
| 6,622,908 | B2 | * | 9/2003 | Fukumoto et al. | 234/98 |
| 6,769,600 | B1 | * | 8/2004 | Knox et al. | 234/98 |
| 6,786,395 | B1 | * | 9/2004 | Lin | 234/98 |
| 7,032,490 | B2 | * | 4/2006 | Lee | 83/588 |
| 7,086,582 | B2 | * | 8/2006 | Yang et al. | 83/687 |
| 2001/0011492 | A1 | * | 8/2001 | Fukumoto et al. | 83/549 |

FOREIGN PATENT DOCUMENTS

| | | | | |
|---|---|---|---|---|
| EP | 1561552 | A1 | * | 8/2005 |
| JP | 02-076699 | | | 3/1990 |
| JP | 09-109094 | | | 4/1997 |
| JP | 2000-233396 | | | 8/2000 |
| JP | 2001009791 | A | * | 1/2001 |
| JP | 2001198889 | A | * | 7/2001 |
| JP | 2002-219693 | | | 8/2002 |
| WO | WO 2004035274 | A1 | * | 4/2004 |

OTHER PUBLICATIONS

English Translation of Second Office Action of Chinese Patent Application No. 2003801018197.

* cited by examiner

BORING DEVICE

TECHNICAL FIELD

The present invention relates to a punching unit for punching holes in a sheet type member by engaging punches with corresponding dies and more specifically to a punching unit which may be most suitably attached to a main unit of an image forming apparatus, such as a copying machine, a printer, a facsimile and a multifunction machine of those machines, or to a printing machine.

BACKGROUND ART

Hitherto, as a punching unit of the sort described above, there have been known a dedicated type punching unit dedicated for punching two holes, three holes or four holes and a switching type punching unit arranged so as to be able to commonly use punches in punching two holes and three holes or two holes and four holes. As the switching type punching unit, there is known a sliding-cam type punching unit wherein a stroke range of a cam is divided into two stages so as to be able to punch two holes in a certain stroke range and to punch three holes in another stroke range as disclosed in Japanese Patent Laid-Open No. 2001-198889.

DISCLOSURE OF INVENTION

However, such sliding-cam type punching unit requires many parts because it requires punches and dies each equal to a total number of holes to be punched, e.g., five each punches and dies in the switching type punching unit for punching two and three holes. Accordingly, it has been desired to realize a punching unit whose punches and dies may be reduced and whose structure may be simplified with a smaller number of parts, while having the function of punching different numbers of holes.

It is therefore an object of the invention to solve the aforementioned problems by providing a punching unit whose punches and dies are reduced as compared to those of the prior art punching unit and whose structure is simplified with a smaller number of parts.

According to one aspect of the invention, a punching unit (30 or 60) is provided with a plurality of punches (52*a* through 53*c* and 53 or 89*a* through 89*d*) and dies (54 or 29) for punching holes in a sheet type member, a reciprocating member (35 or 75) capable of reciprocating in the direction orthogonal to moving directions of the punches, and a plurality of cams (44, 84 and 94, or 11 through 14) and followers (62 or 25) that engage with the cams, interposed between the reciprocating member (35 or 75) and the plurality of punches, for converting the reciprocating movement of the reciprocating member (35 or 75) into a vertical movement of the punches to punching and non-punching positions. The plurality of punches are grouped into a first group composed of a predetermined number of punches and into a second group containing any one of the punches in the first group and having a smaller number of punches than the predetermined number of punches in the first group. A punching state of the predetermined number of punches is produced by reciprocating the reciprocating member (35 or 75) within a first movable range and by vertically moving the punches of the first group through an intermediary of the cams and followers corresponding to the punches of the first group and a punching state of the smaller number of punches than the predetermined number of punches is produced by reciprocating the reciprocating member (35 or 75) within a second movable range and by vertically moving the punches of the second group through an intermediary of the cams and followers corresponding to the punches of the second group.

Accordingly, since the punching unit is capable of producing the punching state of the predetermined number of holes by reciprocating the reciprocating member (35 or 75) within the first movable range and by vertically moving the punches of the first group through the intermediary of the cams and followers corresponding to the punches of the first group and is capable of producing the punching state of the less holes than the predetermined number by reciprocating the reciprocating member (35 or 75) within the second movable range and by vertically moving the punches of the second group through the intermediary of the cams and followers corresponding to the second group, and since any one of the punches of the first group is contained also in the punches of the second group and the number of punches of the second group is fewer than that of the first group, each punch in the first and second groups may be selectively put into operation corresponding to the movement of the reciprocating member (35 or 75) and it becomes possible to lessen the total number of punches used in the different punching processes to be less than a total number of punches of the first and second groups, while having the functions of two units that carry out the processes of punching different number of holes. Thus, the number of punches and corresponding dies may be reduced as compared to those of the prior art unit. Still more, the number of parts may be reduced, the structure of the unit may be simplified and its cost may be lowered. Accordingly, when this punching unit is mounted to an image forming apparatus such as a copying machine, it can contribute to multi-functioning of the apparatus.

Preferably, the first movable range is a range in which the reciprocating member (35) reaches in advancing in one direction from a home position with respect to the main frame and the second movable range is a range in which the reciprocating member (35) reaches in advancing in the other direction from the home position.

Accordingly, the reciprocating member (35) may reach the first or second movable range readily and reliably just by moving in one direction or in the other direction from the home position and hence the control may be simplified.

Preferably, first and second neutral positions are provided on the opposite side from the home position, respectively, in the first and second movable ranges provided at the positions interposing the home position therebetween. The reciprocating member (35) vertically moves the plurality of punches as the first or second group in reciprocating in the first and second movable ranges, respectively.

Accordingly, the mechanism for vertically moving the plurality of punches reliably as the first or second group just by reciprocating the reciprocating member (35) in the first or second movable range may be realized.

Preferably, the first group is composed of three punches (52*a*, 52*b* and 52*c*) arrayed at a predetermined pitch and the common punch (52*b*), that may be commonly used also in the second group, is positioned at the center of the three punches (52*a*, 52*b* and 52*c*) in the first group. The second group is composed of the common punch (52*b*) and a punch (53) dedicated for punching two holes and disposed between the punch (52*c*) positioned at one end among the three punches (52*a*, 52*b* and 52*c*) of the first group and the common punch (52*b*).

Accordingly, since this arrangement produces the three-hole punching state in which the common punch (52*b*) at the center of the first group is positioned at the center and the two-hole punching state in which its center is positioned at the intermediate position between the common punch (52*b*) and the punch (53) dedicated for punching two holes, the two-hole and three-hole punching processes may be freely carried out to the member to be punched by only four punches (52*a* through 52*c* and 53) and dies (54) in total by using the common punch (52*b*) at the center of the three-hole punches (52*a*, 52*b* and 52*c*) also for punching two holes by shifting the respective centers in correspondence to the respective processes. Thus, it becomes possible to readily switch the process for punching three holes at a certain pitch in the member to be punched and the process for punching two holes at a different pitch.

Preferably, the cam (84) corresponding to the common punch (52*b*) is provided with, continuously via a linear portion (87*b*), a first V-shaped portion (85 or 86) capable of moving the common punch (52*b*) from the non-punching position to the punching position when the reciprocating member (35) moves in one direction and a second V-shaped portion (85 or 86) capable of moving the common punch (52*b*) from the non-punching position to the punching position when the reciprocating member (35) moves in the other direction.

Accordingly, since the cam (84) corresponding to the common punch (52*b*) is provided with, continuously via the linear portion (87*b*), the first V-shaped portion capable of moving the common punch (52*b*) when the reciprocating member (35) moves in one direction and the second V-shaped portion capable of moving it when the reciprocating member (35) moves in the other direction, the structure for freely moving the common punch (52*b*) as the punch of the first group or the second group may be realized even though it is simple.

Preferably, the first movable range is a range which the reciprocating member (75) reaches in advancing by one step in one direction from a home position with respect to the main frame and the second movable range is a range to which the reciprocating member (75) reaches in advancing further by one step in one direction from the first movable range.

Accordingly, since the reciprocating member (75) may readily and reliably reach the first or second movable range just by advancing by one step in one direction from the home position or by advancing further by one step in one direction from the first movable range, the control may be simplified.

Preferably, first and second neutral positions are provided in order from the home position in the first and second movable ranges sequentially provided in one direction from the home position. The reciprocating member (75) vertically moves the plurality of punches (89*a* through 89*d*) as the first or second group in reciprocating respectively in the first and second movable ranges.

Accordingly, the plurality of punches (89*a* through 89*d*) may be vertically moved reliably as the first or second group just by reciprocating the reciprocating member (75) within the first or second movable range.

Preferably, the first group is composed of three or more punches (89*a* through 89*d*) arrayed at a predetermined pitch and the second group is composed of at least two punches (89*b* and 89*c*) among the punches in the first group.

Accordingly, because the first group is composed of the four or more punches, i.e., the even number of punches (89*a* through 89*d*), and the second group is composed of the two center punches (89*b* and 89*c*) among the punches (89*a* through 89*d*) of the first group, the four- and two-hole punching processes may be adequately and freely carried out on a sheet P without shifting, in correspondence to each process, the center of each punching state of the four-punching state which is carried out centering on the center part of the four punches (89*a* through 89*d*), i.e., the intermediate position between the punches (89*b* and 89*c*), of the first group and of the two-hole punching state which is carried out centering on the intermediate position between the two center punches (89*b* and 89*c*) of the first group.

Preferably, the punching unit (60) is provided further with move restricting means (23) for restricting the reciprocating member (75) from moving to the movable range on the opposite side in using the reciprocating member (75) within the first or second movable range.

Accordingly, it becomes possible to reduce a number of sensors for detecting the move of the cam plate (75) by the very simple arrangement of just restricting the move of the cam plate (75) to the movable range on the opposite side by the move restricting means (23). That is, when the punching unit (60) is mounted to a main unit of a copying machine or the like, a control is made so as to be able to use only the group actually used often based on data detected by the sensors for detecting the move of the reciprocating member (75) to the group of the opposite side. For instance, when the control is reset after when a supply of electric power is started again from a condition of system-down such as a power failure, the control of shifting the reciprocating member (75) to the group used before the power failure is normally carried out based on the result detected by the sensor. Accordingly, although the sensor (78) is essential, the present invention enables the relatively expensive sensor (78) to be eliminated and the cost to be cut because it restricts the very move of the reciprocating member (75) to the opposite side by the move restricting means (23) and by omitting the sensor (78).

Preferably, the move restricting means (23) is a stopper for blocking the move of the reciprocating member (75) at a predetermined position with respect to the main frame.

Accordingly, since the move restricting means (23) for stopping the move of the reciprocating member (75) at the predetermined position with respect to the main frame may be arranged by the stopper, the move restricting means (23) may be constructed very simply.

Additional objects and advantages of the invention will be apparent from the following detailed description of preferred embodiments thereof, which are best understood with reference to the accompanying drawings.

BRIEF DESCRIPTION OF DRAWINGS

FIGS. 5A through 5C are section views of the punching unit for explaining operations of the punching unit of the present embodiment, wherein FIG. 5A shows a three-hole punching state for punching three holes by punches of a first group, FIG. 5B shows an initial state, and FIG. 5C shows a two-hole punching state for punching two holes by punches of a second group;

BEST MODES FOR CARRYING OUT THE INVENTION

First Embodiment

Figure 1:
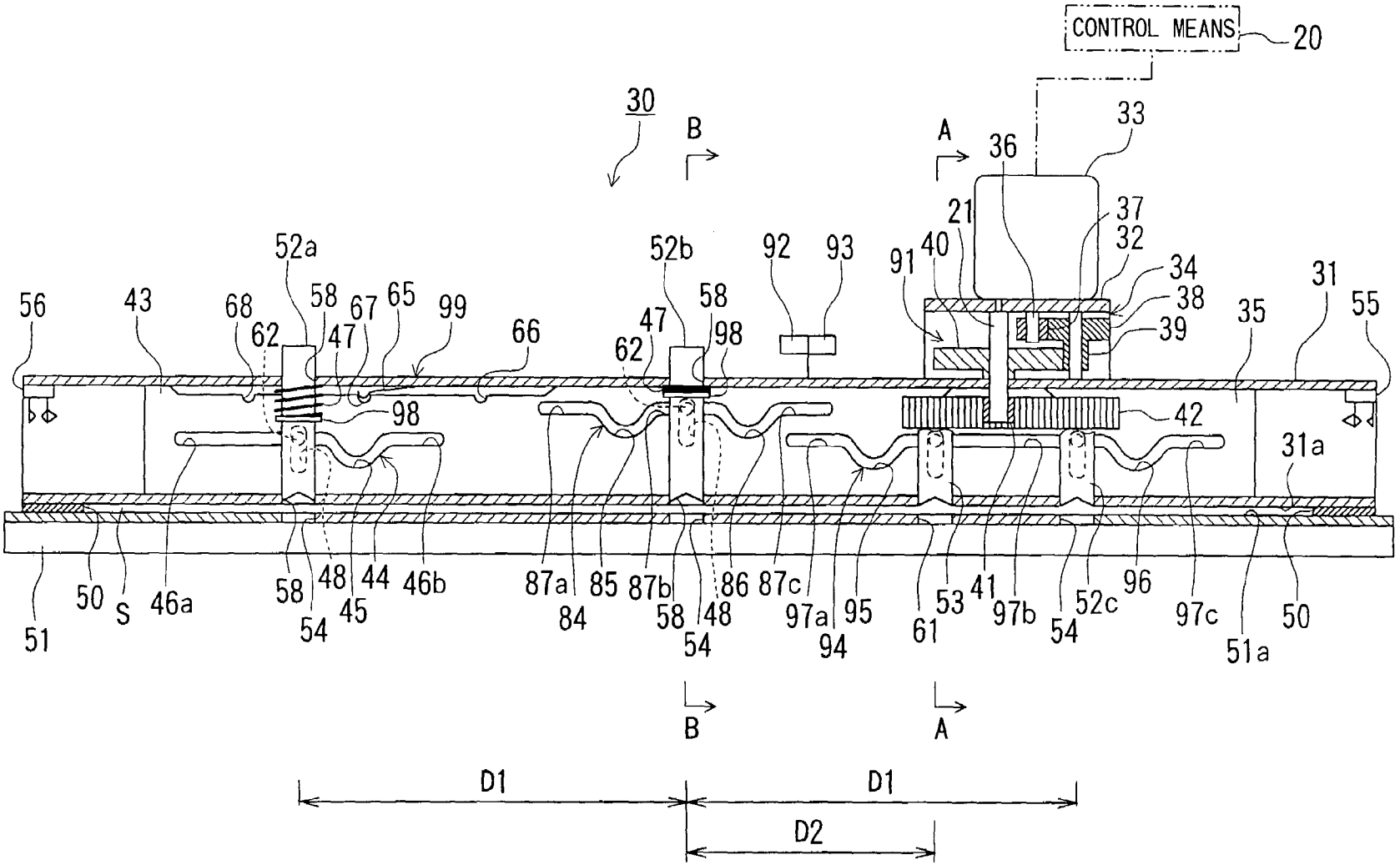
FIG. 1 is a partially broken front view of a punching unit according to a first embodiment of the invention.
Figure 3:
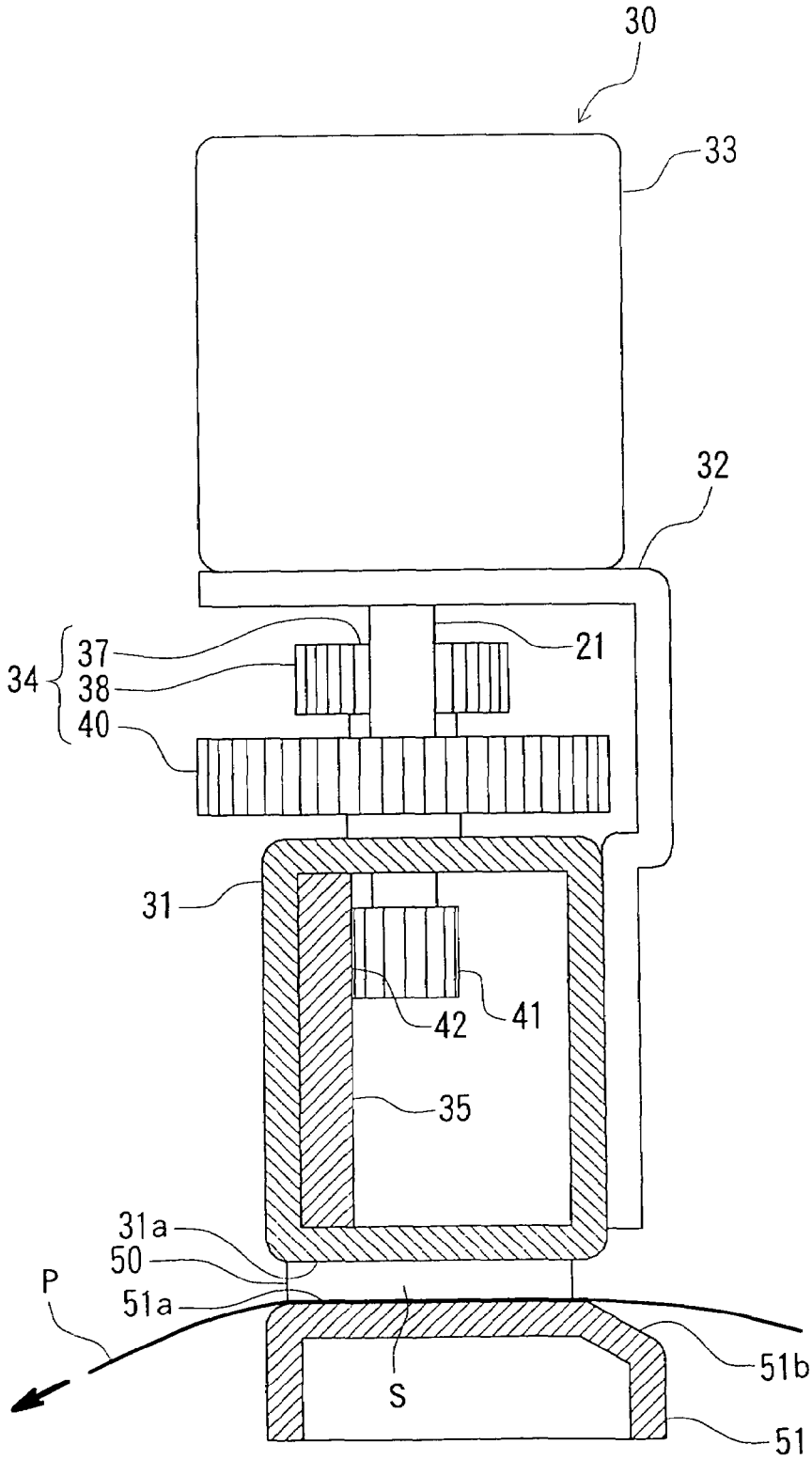
FIG. 3 is a section view of the punching unit taken along a line A-A in FIG. 1.
Figure 4:
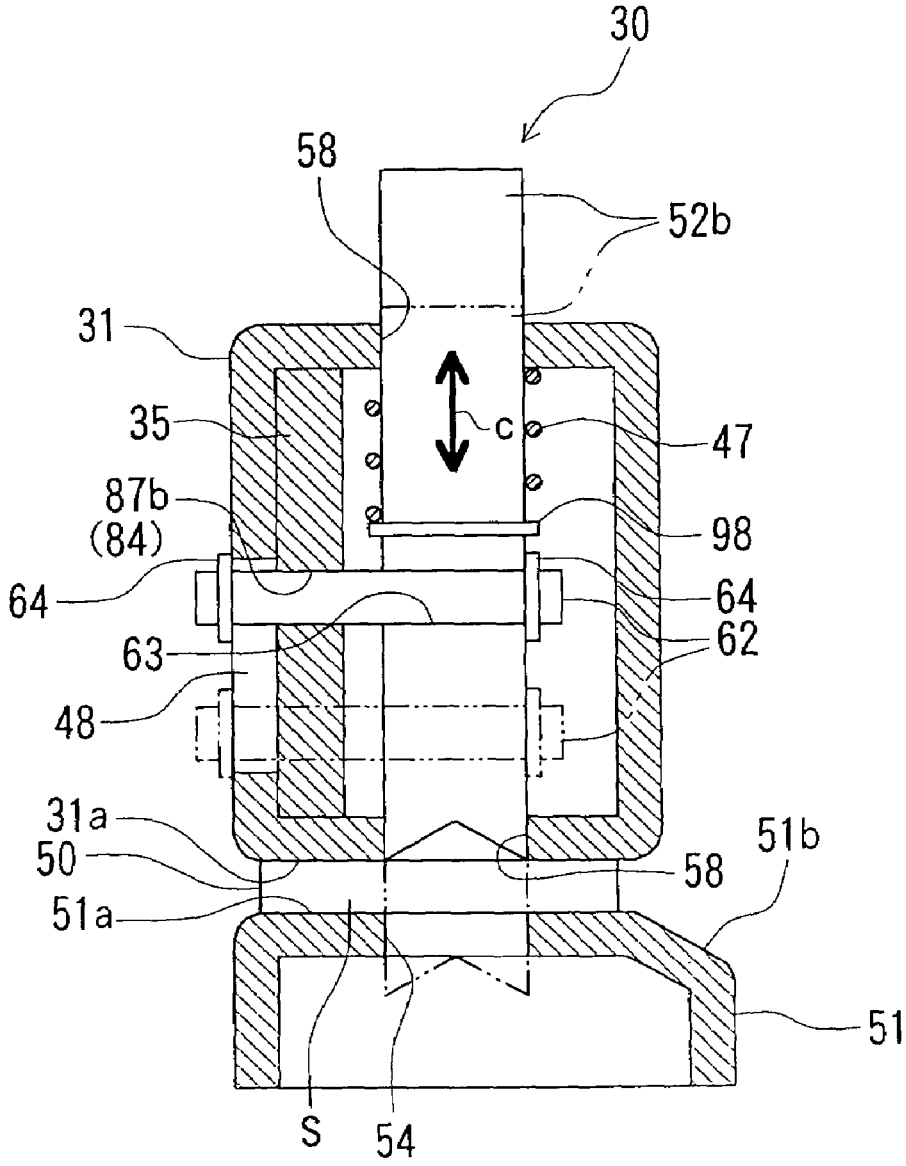
FIG. 4 is a section view of the punching unit taken along a line B-B in FIG. 1.

A first embodiment of an inventive punching unit will be explained below with reference to the drawings. FIG. 1 is a partially broken front view of the punching unit according to the first embodiment of the invention, FIG. 2 is a plan view of the punching unit in FIG. 1, FIG. 3 is a section view of the punching unit taken along a line A-A in FIG. 1, FIG. 4 is a section view of the punching unit taken along a line B-B in FIG. 1 and FIGS. 5A through 5C are section views of the punching unit for explaining operations of the punching unit of the present embodiment.

Figure 2:
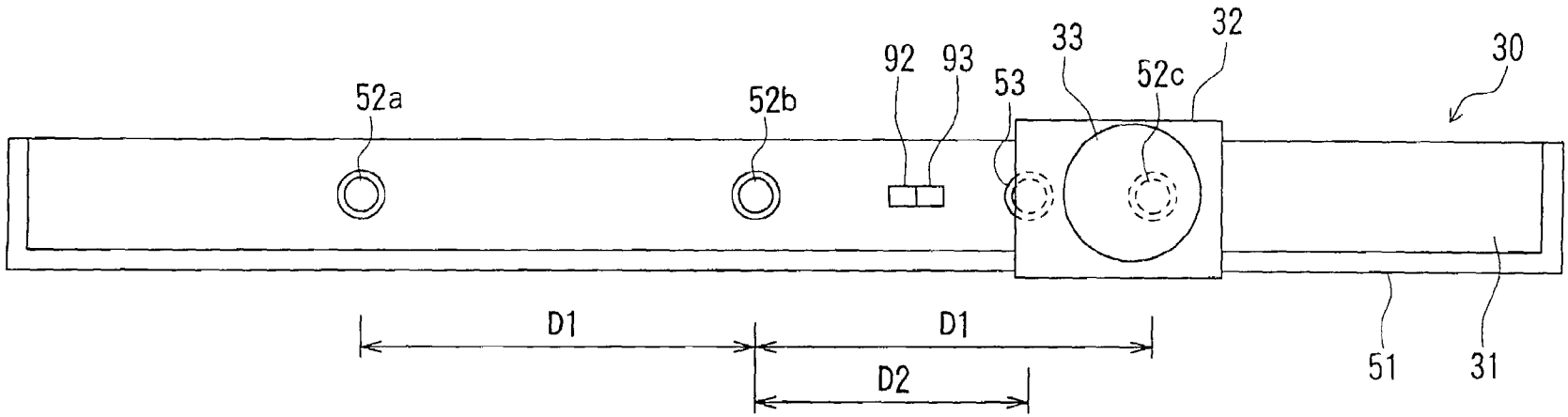
FIG. 2 is a plan view of the punching unit in FIG. 1.

As shown in FIGS. 1 and 2, the punching unit 30 of the present embodiment has a rectangle-tubular main frame 31, on which a motor 33 is disposed through an intermediary of a bracket 32. The motor 33 is linked to a lengthy cam plate (reciprocating member) 35 through an intermediary of a speed reducing gear mechanism 34 and functions as a driving source for moving the cam plate 35 in the lateral direction in FIG. 1. The punching unit 30 is also provided with control means 20 for calculating a number of revolutions, directions of rotation and others of the motor 33 upon receiving detecting signals from the motor 33, punch detecting sensors 92 and 93 and cam plate detecting sensors 55 and 56 described later and for controlling the motor 33 by outputting a corresponding driving signal.

As shown in FIG. 1, the speed reducing gear mechanism 34 has a driving gear 37 fixed to an output shaft 36 of the motor 33 that penetrates through the bracket 32, a large intermediary gear 38 and a small intermediary gear 39 which are formed in a body and are rotatably supported by the bracket 32, a follower gear 40 which is fixed to a shaft 21 rotatably supported by the bracket 32 and whose diameter is larger than that of the intermediary gear 39, a pinion 41 fixed at the end of the shaft 21 within the main frame 31 and a rack 42 engaging with the pinion 41 and provided along the extension of the cam plate 35. It is noted that in FIG. 1, the upper part of punches 53 and 52*c*, which are actually positioned in front of the rack 42 in the figure, is omitted in the figure for convenience.

The cam plate 35 is disposed so as to be able to reciprocate in the lateral direction in FIG. 1 along the inner face of the main frame 31 while receiving a rotational force of the pinion 41 via the rack 42. A part of the upper edge of the cam plate 35 in the vicinity of the left end thereof is slightly cut away and a convex portion 43 is formed at the left end of the upper edge. The convex portion 43 reduces a contact area of the cam plate 35 with the main frame 31, so that sliding resistance decreases and the cam plate 35 slides smoothly.

Three notches 66, 67 and 68 are formed at predetermined intervals in the cut-away portion of the upper edge of the cam plate 35 in the vicinity of the left end thereof and a resilient positioning plate 65 is provided at the inner face of the main frame 31 above the cut-away portion while being biased downward. By engaging with the positioning plate 65, the center notch 67 anchors the cam plate 35 to the center initial position (see FIG. 5B). Similarly, by engaging with the positioning plate 65, the right notch 66 anchors the cam plate 35 to the left end position and the left notch 68 anchors the cam plate 35 to the right end position. The positioning plate 65 and the notches 66, 67 and 68 compose a cam plate positioning mechanism 99. The speed reducing gear mechanism 34 and others compose driving means 91 for converting the rotational force of the motor 33 to linear reciprocating force for reciprocating the cam plate 35 to vertically move punches 52*a*, 52*b*, 53 and 52*c* described later.

The cam plate 35 is provided with three cams 44, 84 and 94 formed in order from the left side of the figure. The cams 44 and 94 are formed so that their level is equal below the center of the cam plate 35 in the vertical direction, i.e., in the direction orthogonal to the longitudinal direction thereof. The cam 84 is positioned above the center of the cam plate 35 in the vertical direction and is formed so that a third linear portion 87*c* overlaps longitudinally with a first linear portion 97*a* of the cam 94.

The cams 44, 84 and 94 are formed respectively so as to penetrate from the front to the back of the cam plate 35 along the longitudinal direction thereof. The cam 44 has a first linear portion 46*a* formed so as to extend by a predetermined width in the longitudinal direction of the cam plate 35 on the level of center of the cam plate 35, a V-shaped portion 45 formed so as to gradually descend at a predetermined angle from the right end of the first linear portion 46*a* and then to gradually ascend from the lowest point (bottom) at a predetermined angle and a second linear portion 46*b* formed so as to extend by a predetermined width from the right end of the V-shaped portion 45 in the longitudinal direction on the same level with the first linear portion 46*a*.

The cam 84 has a first linear portion 87*a* formed so as to extend by a predetermined width in the longitudinal direction of the cam plate 35 on the upper level of the cam plate 35, a V-shaped portion 85 formed so as to gradually descend at the predetermined angle from the right end of the first linear portion 87*a* and then to gradually ascend from the bottom at the predetermined angle, a second linear portion 87*b* formed so as to extend by a predetermined width from the right end of the V-shaped portion 85 in the longitudinal direction on the same level with the first linear portion 87*a*, a V-shaped portion 86 formed so as to gradually descend at the predetermined angle from the right end of the second linear portion 87*b* and then to gradually ascend from the bottom at the predetermined angle, and a third linear portion 87*c* formed so as to extend by a predetermined width from the right end of the V-shaped portion 86 in the longitudinal direction on the same level with the first and second linear portions 87*a* and 87*b*.

The cam 94 has a first linear portion 97*a* formed so as to extend by a predetermined width in the longitudinal direction of the cam plate 35 on the level of center of the cam plate 35, a V-shaped portion 95 formed so as to gradually descend at the predetermined angle from the right end of the first linear portion 97*a* and then to gradually ascend from the bottom at the predetermined angle, a second linear portion 97*b* formed so as to extend by a predetermined width from the right end of the V-shaped portion 95 in the longitudinal direction on the same level with the first linear portion 97*a*, a V-shaped portion 96 formed so as to gradually descend at the predetermined angle from the right end of the second linear portion 97*b* and then to gradually ascend from the bottom at the predetermined angle, and a third linear portion 97*c* formed so as to extend by a predetermined width from the right end of the V-shaped portion 96 in the longitudinal direction on the same level with the first and second linear portions 97*a* and 97*b*.

The punching unit 30 has the punches 52*a*, 52*b* and 52*c*, for use in punching three holes, which are supported movably in the direction orthogonal to the longitudinal direction at intervals of a predetermined distance D1 in the longitudinal direction of the main frame 31 (cam plate 35). The punching unit 30 also has a punch 53 dedicated for use in punching two holes and supported movably in the direction orthogonal to the longitudinal direction between the punches 52*b* and 52*c* apart from the punch 52*b* by a distance D2 that is shorter than the distance D1. The punch 52*b* is used also in punching two holes as described later.

These punches 52*a*, 52*b*, 53 and 52*c* as well as the cams 44, 84 and 94 are arranged so as to have a predetermined positional relationship as described later. It is noted that pins 62, which are supported respectively by the punches 52*a*, 52*b*, 53 and 52*c*, are slidably inserted through the cams 44, 84 and 94.

Figures 5A, 5B, 5C:
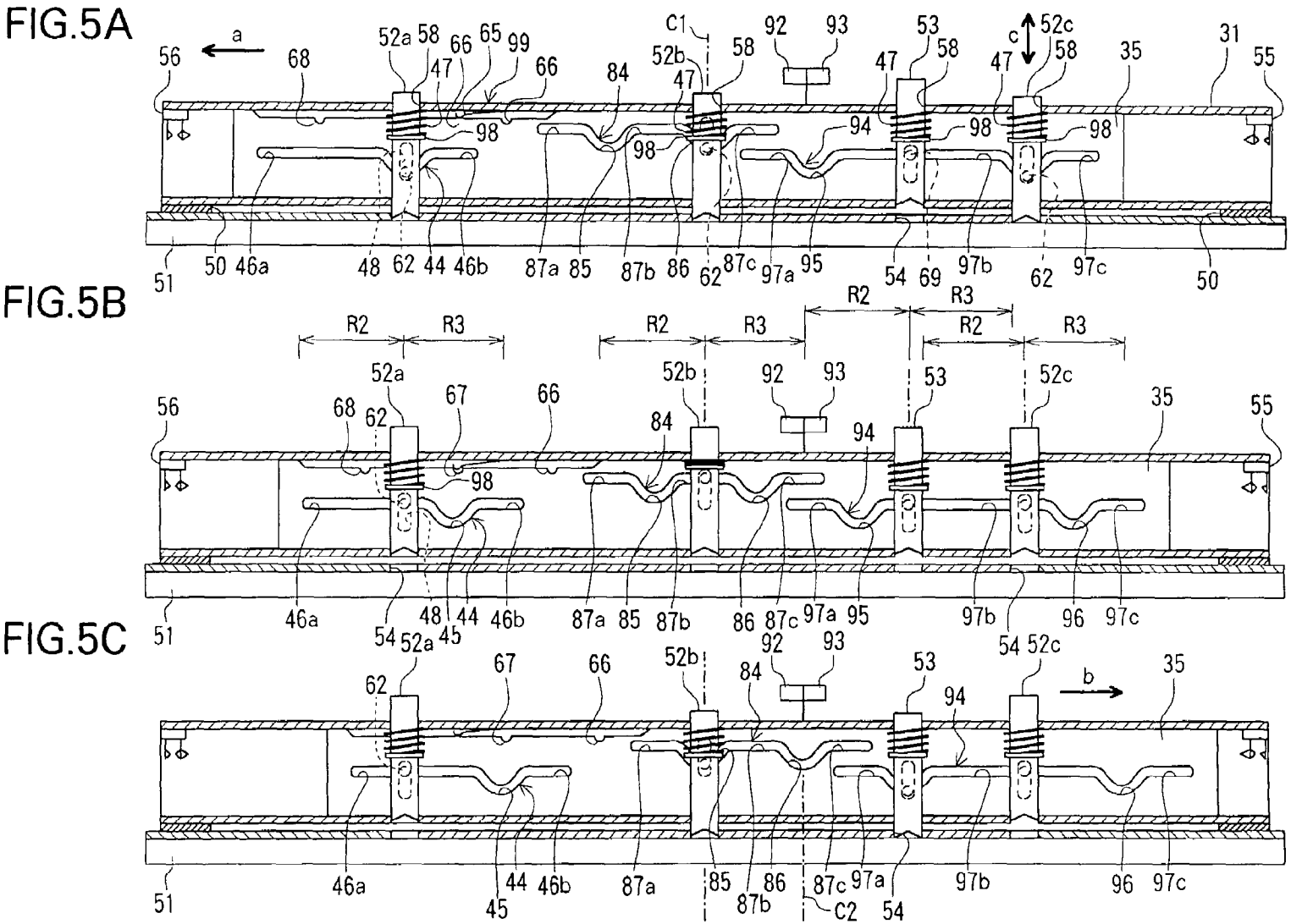

That is, in the initial state in which the cam plate 35 is positioned at the center part of the main frame 31 as shown in FIGS. 1 and 5B, the pin 62 of the punch 52*a* is positioned in the first linear portion 46*a* near the V-shaped portion 45, the pin 62 of the punch 52*b* is positioned in the center part of the second linear portion 87*b*, the pin 62 of the punch 53 is positioned in the second linear portion 97*b* near the V-shaped portion 95, and the pin 62 of the punch 52*c* is positioned in the second linear portion 97*b* near the V-shaped portion 96.

Still more, in a three-hole punching state for punching three holes as shown in FIG. 5A, the pins 62 of the punches 52*a*, 52*b* and 52*c* are positioned in the V-shaped portion 45 of the cam 44, in the V-shaped portion 86 of the cam 84 and in the V-shaped portion 96 of the cam 94, respectively, and the pins 62 of the punch 53 dedicated for punching two holes is positioned in the center part of the second linear portion 97*b* of the cam 94.

Further, in a two-hole punching state for punching two holes as shown in FIG. 5C, the pins 62 of the punches 52*b* and 53 are positioned in the V-shaped portion 85 of the cam 84 and in the V-shaped portion 96 of the cam 94, respectively, and the pins 62 of the punches 52*a* and 52*c* dedicated for punching three holes are positioned in the left end of the first linear portion 46*a* of the cam 44 and in the center part of the second linear portion 97*b* of the cam 94, respectively.

In order to realize the initial state, the three-hole punching state and the two-hole punching state described above, the cams 44, 84 and 94 have the following positional relationship from each other.

That is, as shown in FIGS. 1, 2 and 5, they are arranged so that the pitch (D1) of the three-hole punches 52*a*, 52*b* and 52*c* is equal to the pitch of the bottoms of the V-shaped portion 45, 86 and 96 corresponding thereto. Still more, they are set so that the length of the second linear portion 46*b* of the cam 44, the first linear portion 87*a*, the second linear portion 87*b* and the third linear portion 87*c* of the cam 84, and the first linear portion 97*a* and the third linear portion 97*c* of the cam 94 are equal to each other, and so that the first linear portion 97*a* of the cam 94 overlaps with the third linear portion 87*c* of the cam 84.

Further, the second linear portion 97*b* of the cam 94 is set so as to have a length slightly longer than a distance between the punches 53 and 52*c* so as to be able to keep the both neighboring punches 53 and 52*c* at the highest position (non-punching position) in the initial state described above, to forward the punch 52*c* to the V-shaped portion 96 and to keep the punch 53 at the highest position in the three-hole punching state described above, and to forward the punch 53 to the V-shaped portion 95 and to keep the punch 52*c* at the highest position in the two-hole punching state described above.

The cam 44 is set so that the first linear portion 46*a* of the cam 44 has a length equal to that of the second linear portion 97*b* of the cam 94 so as to be able to keep the punch 52*a* at the highest position until when the two-hole punching state in FIG. 5C passes from the initial state in FIG. 5B.

Meanwhile, as shown in FIGS. 1, 3 and 4, a leg 51 is attached to a lower face 31*a* of the main frame 31 through an intermediary of spacers 50. The spacer 50 is provided to form a gap S that permits sheets (member to be punched) P to pass between the lower face 31*a* and an upper face 51*a* of the leg 51. A slope 51*b* for guiding the sheet P to the gap S is formed at the corner of the leg 51 as shown in FIG. 3.

As shown in FIG. 1, the main frame 31 is provided with eight punch-supporting holes 58 in total formed so as to penetrate through the upper and lower faces of the main frame 31. The punches 52*a*, 52*b*, 53 and 52*c* are slidably inserted through these punch-supporting holes 58, respectively. Four dies 54 are formed through the upper face 51*a* of the leg 51 so as to face to the punch-supporting holes 58 at the lower face of the main frame 31, respectively. An internal diameter of each die 54 is set to be almost equal to an outside diameter of the respective punches 52*a*, 52*b*, 53 and 52*c* to which the respective dies engage.

The punches 52*a*, 52*b* and 52*c* are arrayed at an equal pitch (D1) and compose a first group for punching three holes in the sheet P. The punch 53 composes, together with the punch 52*b* (common punch) that is also used for punching three holes, a second group for punching two holes in the sheet P.

Then, as shown in FIGS. 1 and 4, the punch 52*b* for example is provided with a through hole 63 in the direction orthogonal to its moving direction (vertical direction in the figure) c. The through hole 63 supports the aforementioned pin (follower) 62 so that it penetrates through the hole 63 and the second linear portion 87*b* and protrudes toward a guide long hole 48 of the main frame 31. The guide long hole 48 is formed so as to penetrate through a side wall of the main frame 31 and so that its longitudinal direction coincides with the vertical direction. Removable stop rings 64 are fitted to the both ends of the pin 62 so that the pin 62 will not come out of the through hole 63 of the punch 52*b*.

Still more, the punch 52*b* is provided with a spring 47 that biases the punch 52*b* toward the corresponding die 54. The spring 47 is interposed between the upper edge of the main frame 31 and a stop ring 98 fixed to the punch 52*b*. Although the spring 47 biases the punch 52*b* downward, the punch 52*b* will not come out of the main frame 31 because the pin 62 penetrates through the second linear portion 87*b* of the cam 84 and is held by that.

It is noted that the punch 52*b* indicated by a solid line in FIG. 4 shows the state in which it is positioned at the highest position and that indicated by a two-dotted line shows the state in which it is positioned at the lowest position (punching position). It is noted that although the supporting structure has been described centering on that of the punch 52*b*, the structures for supporting the other punches 52*a*, 53 and 52*c* are the same with that and an explanation thereof will be omitted here.

Further, as shown in FIG. 1, cam plate detecting sensors 55 and 56 for detecting that the cam plate 35 has reached to the right or left end are provided at the both ends of the movable range of the cam plate 35 within the main frame 31. Still more, a punch detecting sensor 92 for detecting the upper end of the punch 52*b* among the three-hole punches 52*a*, 52*b* and 52*c* and a punch detecting sensor 93 for detecting the upper end of the punch 53 among the two-hole punches 52*b* and 53 are provided on the upper face of the main frame 31.

In the punching unit 30 of the present embodiment having the structure described above, a range within which the cam plate 35 reaches when it is moved to the left as shown in FIG. 5A from the home position, i.e., the initial state in FIG. 5B, will be defined as a first movable range R3 and a range within which the cam plate 35 reaches when it is moved to the right as shown in FIG. 5C from the home position will be defined as a second movable range R2.

The three-hole punching state using the three-hole punches 52*a*, 52*b* and 52*c* as the first group is obtained by reciprocating the cam plate 35 within the first movable range R3 and the two-hole punching state using the two-hole punches 52*b* and 53 as the second group is obtained by reciprocating the cam plate 35 within the second movable range R2.

When the home position is denoted as $N_2$ and the position where all of the punches separate from the dies 54, thus producing the non-punching state beside the home position, is defined as a neutral position, a neutral position $N_1$ and a neutral position $N_3$ exist respectively on the opposite side from the home position $N_2$ with respect to an intermediate position described later where the punching state is produced in the first and second movable ranges R3 and R2. That is, with respect to the first and second movable ranges R3 and R2 interposing the home position $N_2$ therebetween, this state may be expressed as follows:

$N_1 \leftarrow\rightarrow$ three-hole punching state (R3) $\leftarrow N_2 \rightarrow$ two-hole punching state (R2) $\leftarrow\rightarrow N_3$

Operation in Punching Three Holes

In the initial state of the punching unit 30 in which the motor 33 is stopped, the positioning plate 65 of the cam plate positioning mechanism 99 engages with the notch 67 and the cam plate 35 is held at the center within the main frame 31 as shown in FIG. 1 (i.e., in FIG. 5B). At this time, the pin 62 of the punch 52*a* is positioned in the first linear portion 46*a* of the cam 44, the pin 62 of the punch 52*b* is positioned in the second linear portion 87*b* of the cam 84 and the pins 62 of the punches 53 and 52*c* are positioned in the second linear portion 97*b* of the cam 94, respectively. That is, all of the punches are kept at the highest positions.

When the sheet P is fed into the gap S between the main frame 31 and the leg 51 through an intermediary of sheet conveying means (not shown) and is positioned at a predetermined position in this initial state, a sensor (not shown) detects that the sheet P has been fed to the punching unit 30. Then, based on this detection, the control means 20 turns on the punching unit 30. It is assumed that a user has made a setting for punching three holes in advance by this point of time.

Then, the control means 20 drives the motor 33 to move the cam plate 35 so as to shift from the initial state in FIG. 5B to the three-hole punching state in FIG. 5A. Then, because the cam plate 35 starts to move to the left, the pin 62 of the punch 52*a* is guided from the first linear portion 46*a* to the bottom of the V-shaped portion 45, the pin 62 of the punch 52*b* is guided from the second linear portion 87*b* to the bottom of the V-shaped portion 86 and the pin 62 of the punch 52*c* is guided from the second linear portion 97*b* to the bottom of the V-shaped portion 96.

Thereby, the three-hole punches 52*a*, 52*b* and 52*c* drop to the lowest position, respectively, and engage with the dies 54 after punching holes in the sheet P as shown in FIG. 5A. At the same time, when the punch detecting sensor 92 detects that the punch 52*b* that is one of the three-hole punches is positioned at the lowest position, the control means 20 recognizes that three holes have been punched in the sheet P by the punches 52*a*, 52*b* and 52*c* of the first group. In this state, the cam plate 35 is positioned at the intermediate position of the first movable range R3 after moving from the home position $N_2$.

Then, in response to a signal from the control means 20, the motor 33 rotates and continues to move the cam plate 35 to the left, so that the cams 44, 84 and 94 lead the respective pins 62 to the second linear portion 46*b*, the third linear portion 87*c* and the third linear portion 97*c* and lift and keep the respective punches 52*a*, 52*b* and 52*c* at the highest position while keeping the punch 53 at the highest position by the second linear portion 97*b* of the cam 94. At this time, the cam plate 35 moves to the leftmost end and the positioning plate 65 of the cam plate positioning mechanism 99 engages with the notch 66, so that the cam plate 35 is held at that position. That is, the cam plate 35 is positioned at the final end of the first movable range R3 in this state.

At this point of time, the sheet P in which the three holes have been punched is pulled out of the gap S (see FIG. 3) and a new sheet P is fed to the gap S. When the motor 33 rotates reversely by a predetermined number of revolution in this state and when the cam plate 35 which is positioned at the left end moves to the right, i.e., when the cam plate 35 moves from the end of the first movable range R3 to the intermediate position, three holes are punched in the new sheet P by the three-hole punches 52*a*, 52*b* and 52*c*. When the cam plate 35 moves further to the right, i.e., when the cam plate 35 moves from the intermediate position of the first movable range R3 to the home position $N_2$, the pins 62 of the punches 52*a*, 52*b* and 52*c* are led to the first linear portion 46*a*, the second linear portion 87*b* and the second linear portion 97*b*, respectively. Then, the positioning plate 65 engages with the notch 67 and the cam plate 35 returns to the initial state in FIG. 5B.

Thus, the punching unit 30 is capable of repeatedly carrying out the operation of punching three holes by the punches 52*a*, 52*b* and 52*c* by reciprocating the cam plate 35 within the first movable range R3.

Operation in Punching Two Holes

When a sheet P is fed to the gap S between the main frame 31 and the leg 51 and stops at the predetermined position in the initial state in FIG. 5B in which the motor 33 is stopped, the control means 20 turns on the punching unit 30 based on the detection of the sensor not shown. It is assumed that the user has made a setting for punching two holes in advance by this point in time.

Then, the control means 20 drives the motor 33 to move the cam plate 35 so as to shift the state from the initial state in FIG. 5B to the two-hole punching state in FIG. 5C. Thereby, while the cam plate 35 starts to move to the right, the pins 62 of the punches 52*a* and 52*c* not used in punching two holes are held as they are at the highest position by the first linear portion 46*a* and the second linear portion 97*b* engaging therewith in the initial state. In contrast to that, the pin 62 of the punch 52*b* that is also used in punching three holes is guided from the second linear portion 87*b* to the bottom of the V-shaped portion 85 and the pin 62 of the punch 53 is guided from the second linear portion 97*b* to the bottom of the V-shaped portion 95.

Thereby, the two-hole punches 52*b* and 53 drop to the lowest position, respectively, and engage with the dies 54 after punching holes in the sheet P as shown in FIG. 5C. At the same time, when the punch detecting sensor 93 detects that the punch 53, which is one of the two-hole punches, is positioned at the lowest position, the control means 20 recognizes that two holes have been punched in the sheet P by the punches 52*b* and 53 of the second group. That is, the cam plate 355 is positioned in the intermediate position of the second movable range R2 after moving from the home position $N_2$.

Then, in response to the signal from the control means 20, the motor 33 rotates and continues to move the cam plate 35 further to the right, so that the cams 84 and 94 lead the respective pins 62 to the first linear portion 87*a* and the first linear portion 97*a* and lift and keep the respective punches 52*b* and 53 at the highest position while keeping the punches 52*a* and 52*c* at the highest position by holding the respective pins 62 in the first linear portion 46*a* and the second linear portion 97*b* of the cams 44 and 94. At this time, the cam plate 35 moves to the rightmost end and the positioning plate 65 of the cam plate positioning mechanism 99 engages with the notch 68, so that the cam plate 35 is held at that position. That is, the cam plate 35 is positioned at the final end of the second movable range R2.

At this point in time, the sheet P in which two holes have been punched is pulled out of the gap S (see FIG. 3) and a new sheet P is fed to the gap S. When the motor 33 rotates reversely by a predetermined number of revolutions in this state and when the cam plate 35 that is positioned at the right end moves to the left, i.e., when the cam plate 35 moves from the final end of the second movable range R2 to the intermediate position $N_2$, two holes are punched in the new sheet P by the two-hole punches 52*b* and 53. When the cam plate 35 moves further to the left, i.e., when the cam plate 35 moves from the intermediate position of the second movable range R2 to the home position $N_2$, the pins 62 of the punches 52*b* and 53 are led to the second linear portion 87*b* and the second linear portion 97*b*, respectively. Then, the positioning plate 65 engages with the notch 67 and the cam plate 35 returns to the initial state in FIG. 5B.

Thus, the punching unit 30 is capable of repeatedly carrying out the operation of punching two holes by the punches 52*b* and 53 by reciprocating the cam plate 35 within the second movable range R2.

As described above, the punching unit 30 of the present embodiment is capable of punching three holes by moving the cam plate 35 to the left from the intermediate position and of punching two holes by moving the cam plate 35 to the right from the intermediate position. That is, it is possible to punch different numbers of holes at different positions of the sheet P by one unit.

At this time, because a position C1 corresponding to the position of the punch 52*b* becomes the center in punching three holes as shown in FIG. 5A and a position C2 corresponding to the position between the punches 52*b* and 53 becomes the center in punching two holes as shown in FIG. 5C, it is desirable to adopt the following methods in punching two and three holes in the sheet P having the same size.

For instance, the relative position of the whole punching unit 30 and a unit mounting section of a copying machine or the like mounting the punching unit 30 is shifted by position changing means not shown so that the center C2 coincides with the center C1. Or, the position for feeding the sheet to the punching unit 30 by the sheet conveying means not shown in a copying machine or the like mounting the punching unit 30 is changed in punching two holes and in punching three holes. The punching process may be smoothly carried out while eliminating misalignment of centers in punching two and three holes by adequately adopting these methods.

While the punches 52*a*, 52*b*, 53 and 52*c* are provided, respectively, with the springs 47 for biasing the punches in the direction of approaching to the corresponding dies, the spring 47 adds a thrust force to each punch in punching a hole in the sheet P and also becomes a load in separating the respective punch from its corresponding die. It enables the load applied to the motor 33 required in moving the cam plate 35 to be almost uniformed and enables the process of continuously punching holes in the sheet P to be smoothly carried out.

Further, although the pins 62 have been provided on the side of the punches 52*a*, 52*b*, 53 and 52*c*, and the cams 44, 84 and 94 have been provided on the side of the cam plate 35, it is possible to reverse this relationship and to provide the cams on the side of the punches 52*a*, 52*b*, 53 and 52*c* and to provide the pins on the side of the cam plate 35.

As described above, the punching unit 30 of the present embodiment is capable of producing the three-hole punching state by reciprocating the cam plate 35 within the first movable range R3 to vertically move the punches 52*a*, 52*b* and 52*c* of the first group through the intermediary of the cams 44, 84 and 94 corresponding to the punches of the first group and the pins (followers) 62, and of producing the two-hole punching state in which holes to be punched is fewer than that of the first group by reciprocating the cam plate 35 within the second movable range R2 to vertically move the punches 52*b* and 53 of the second group. Further, because the second group includes the punch 53 that also belongs to the first group and the number of punches thereof is smaller than that of the first group, the total number of punches (four) used in the different punching processes may be lessened as compared to the total number of punches (five) of the first and second groups by selectively operating the respective punches of the first and second groups corresponding to the move of the cam plate 35 while having the function of two units carrying out the processes of punching the different number of holes. Thus, it allows the number of punches and corresponding dies to be reduced as compared to those of the prior art, the number of parts to be reduced and the structure of the unit to be simplified. It may also bring down the cost and will contribute to multi-functioning of an image forming apparatus such as a copying machine when it is mounted thereto.

Further, because it is capable of readily and steadily shifting to the first movable range R3 or to the second movable range R2 just by moving the cam plate 35 to the left or right from the home position $N_2$, its control may be simplified. Still more, it realizes the structure of vertically moving the punches 52*a*, 52*b*, 53 and 52*c* reliably as the first or second group just by reciprocating the cam plate 35 in the first movable range R3 or in the second movable range R2.

While the punching unit 30 produces the three-hole punching state centering on the common punch 52*b* positioned at the center of the first group and the two-hole punching state centering on the intermediate position between the common punch 52*b* and the punch 53 dedicated for punching two holes, it is freely capable of carrying out the two-hole and three-hole punching processes adequately to the sheet (to be punched) P just by the four punches (and dies) in total in which the common punch 52*b* at the center of the three-hole punches is used also in punching two holes by shifting the respective centers corresponding to the respective processes. That is, it becomes possible to readily switch the process of punching three holes in the sheet P with a certain pitch and the process of punching two holes with a pitch different thereto.

Still more, because the cam 84 corresponding to the common punch 52*b* is provided with the V-shaped portion 86 capable of operating the common punch 52*b* when the cam plate 35 moves to the left and the V-shaped portion 85 capable of operating the common punch 52*b* when the cam plate 35 moves to the right continuously via the second linear portion 87*b*, the structure that permits the common punch 52*c* to be freely operated as the first or second group may be realized even though its structure is so simplified.

Second Embodiment

Figure 6:
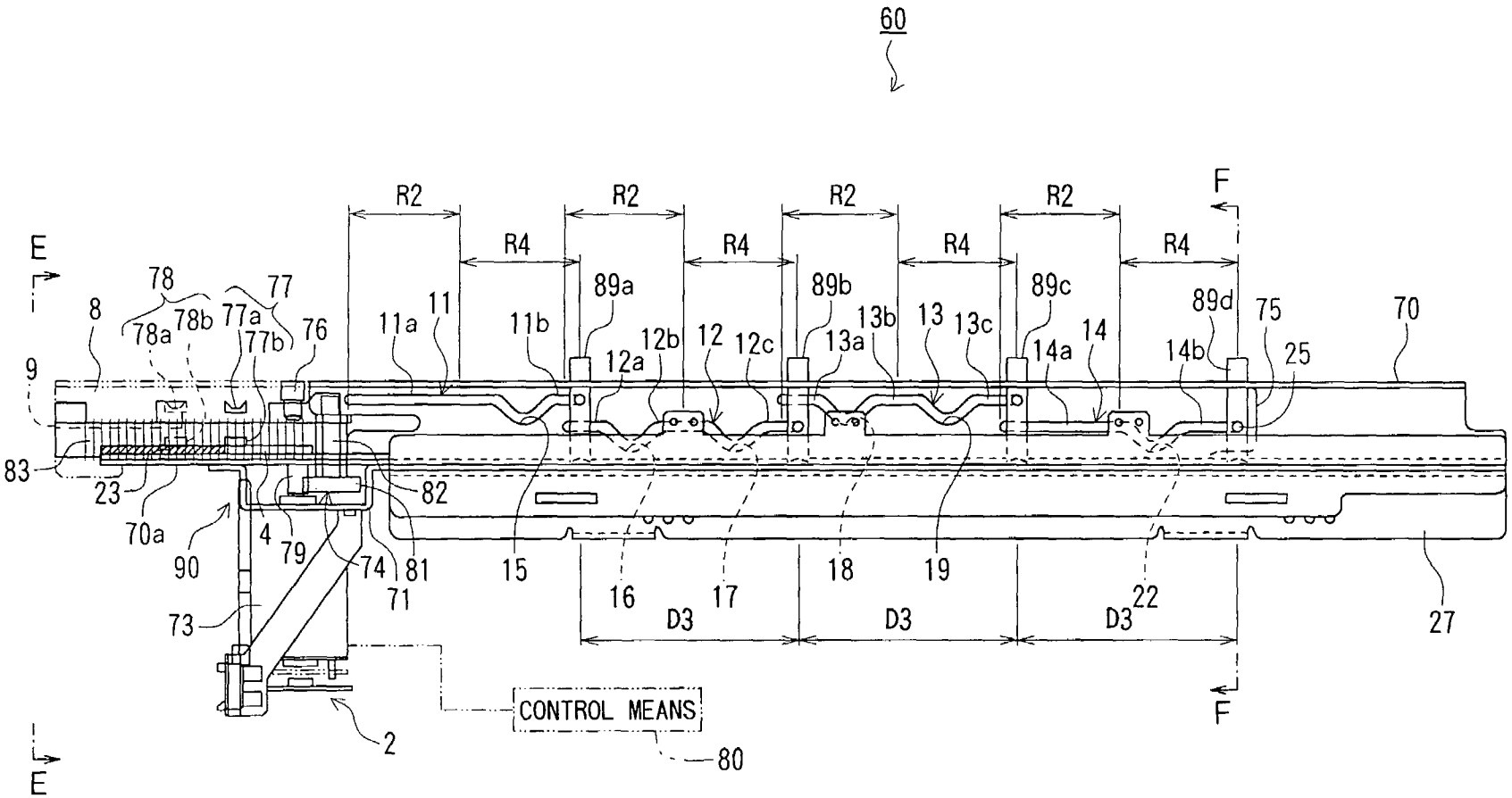
FIG. 6 is a partially broken front view of a punching unit according to a second embodiment of the invention.
Figure 7:
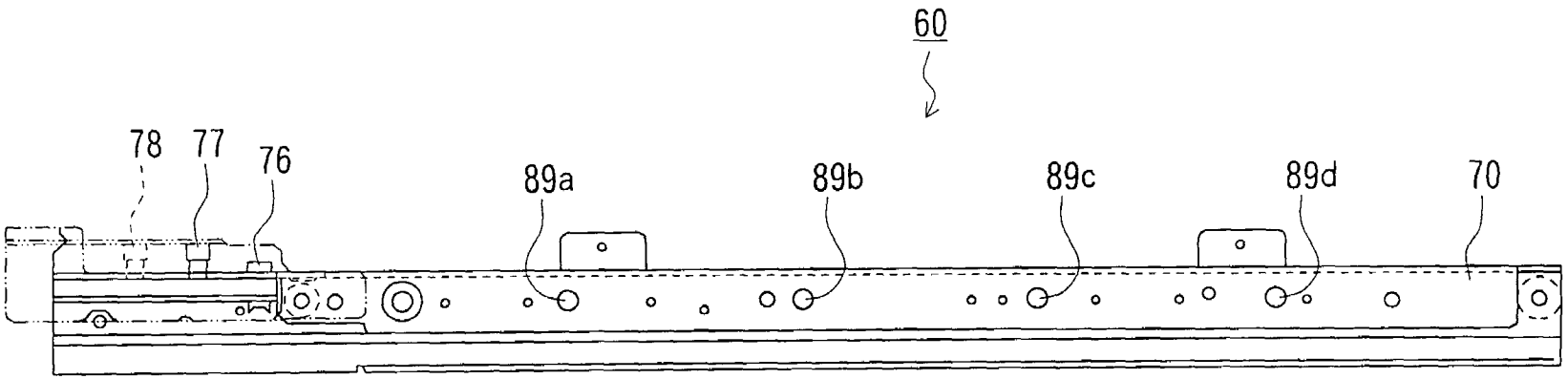
FIG. 7 is a plan view of the punching unit in FIG. 6.
Figure 8:
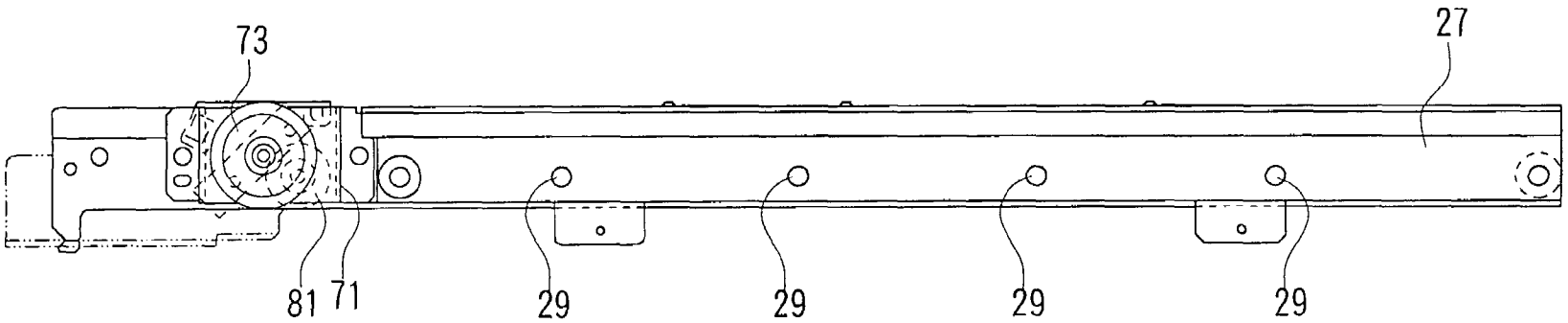
FIG. 8 is a bottom view of the punching unit in FIG. 6.
Figure 9:
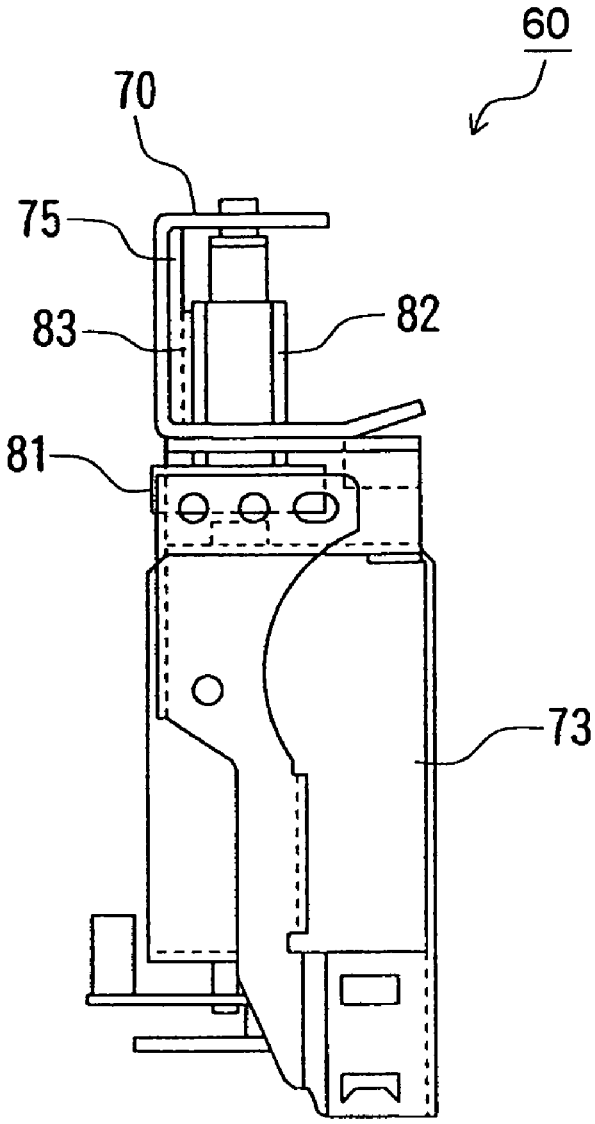
FIG. 9 is a side view of the punching unit taken along a line E-E in FIG. 6.
Figure 10:
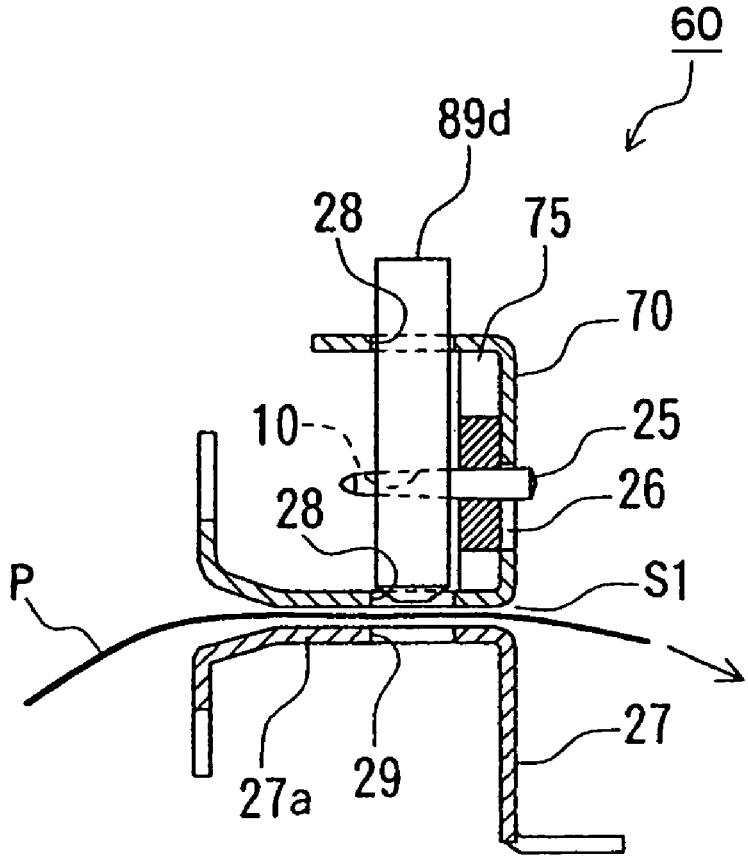
FIG. 10 is a side section view of the punching unit taken along a line F-F in FIG. 6.
Figure 11:
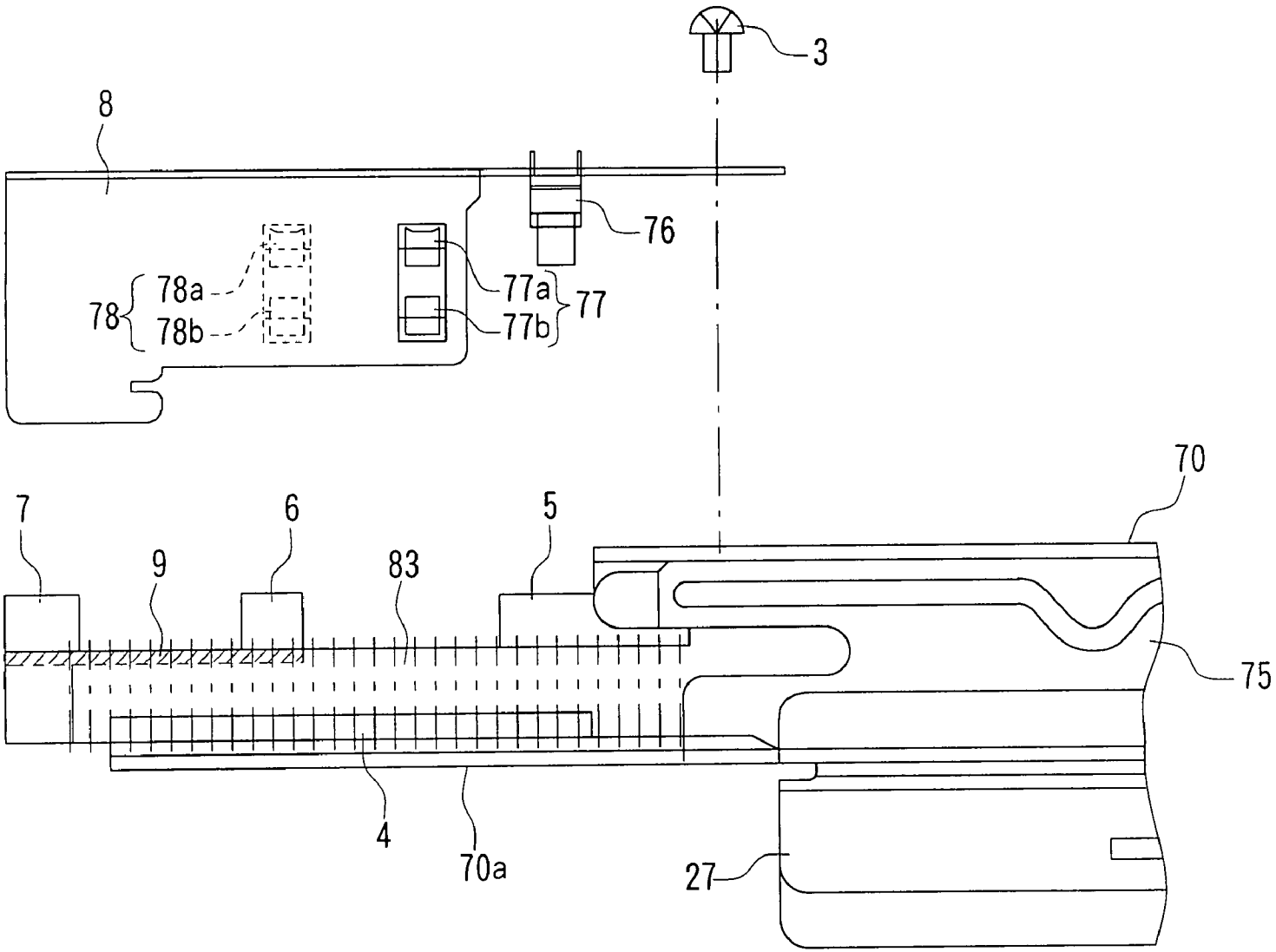
FIG. 11 is a partially enlarged front view of a movable range detecting sensor, a rack and others in FIG. 6.

Next, a second embodiment of the inventive punching unit will be explained with reference to FIGS. 6 through 11. FIG. 6 is a partially broken front view of a punching unit according to a second embodiment of the invention, FIG. 7 is a plan view of the punching unit in FIG. 6, FIG. 8 is a bottom view of the punching unit in FIG. 6, FIG. 9 is a side view of the punching unit taken along a line E-E in FIG. 6, FIG. 10 is a side section view of the punching unit taken along a line F-F in FIG. 6 and FIG. 11 is a partially enlarged front view of a movable range detecting sensor, a rack and others in FIG. 6.

As shown in FIGS. 6 through 11, the punching unit 60 of the present embodiment is provided with a motor 73 on a main frame 70 through an intermediary of a bracket 71. The motor 73 is linked to a lengthy cam plate (reciprocating member) 75 through the intermediary of a speed reducing gear mechanism 74 and functions as a driving source for moving the cam plate 75 in the lateral direction. The punching unit 60 has control means 80 for controlling the motor 73 based on detecting signals received form movable range detecting sensors 76, 77 and 78. It is noted that an encoder 2 in FIG. 6 detects a number of revolution and others of the motor 73.

As shown also in FIG. 6, the speed reducing gear mechanism 74 has a driving gear 79 fixed to an output shaft of the motor 73 that penetrates through the bracket 71, large and small gears 81 and 82 formed in a body and rotatably supported by the bracket 71, and a rack 83 linked to the left end portion of the cam plate 75 while extending in the longitudinal direction of the cam plate 75 and engaging with the small gear 82.

The cam plate 75 is disposed so as to be able to reciprocate in the lateral direction of the figure along the inner face, i.e., in the rear side of FIG. 6, of the main frame 70 while receiving a rotational force of the small gear 82 through the intermediary of the rack 83. The speed reducing gear mechanism 74 and others compose driving means 90 for converting the rotational force of the motor 73 to a linear reciprocal force of the cam plate 755 for vertically moving punches 89*a*, 89*b*, 89*c* and 89*d* described later.

The cam plate 75 is provided with four cams 11, 12, 13 and 14 formed in order from the left side of the figure. The cams 12 and 14 are formed so that their level in the direction orthogonal to the longitudinal direction of the cam plate 75, i.e., in the vertical direction in the figure, is equal under the center thereof. The cams 11 and 13 are positioned above the center in the direction orthogonal to the longitudinal direction of the cam plate 75.

The cams 11 through 14 penetrate from the front to the back of the cam plate 75 along the longitudinal direction of the cam plate 75. The cam 11 has a first linear portion 11*a* formed so as to extend by a predetermined width in the longitudinal direction on the upper level of the cam plate 75 in the direction orthogonal to the longitudinal direction thereof, a V-shaped portion 15 that drops gradually at a predetermined angle from the right end of the first linear portion 11*a* and then rises gradually at the predetermined angle from the lowest part (bottom), and a second linear portion 11*b* extending from the right end of the V-shaped portion 15 by a predetermined width in the longitudinal direction on the same level with the first linear portion 11*a*.

The cam 12 has a first linear portion 12*a* formed so as to extend by a predetermined width in the longitudinal direction on the lower level of the cam plate 75 and so as to overlap by a predetermined length with the second linear portion 11*b* of the cam 11, a V-shaped portion 16 that drops from the right end of the first linear portion 12*a* gradually at the predetermined angle and then rises from the bottom gradually at the predetermined angle, a second linear portion 12*b* extending from the right end of the V-shaped portion 16 by a predetermined width in the longitudinal direction on the same level with the first linear portion 12*a*, a V-shaped portion 17 that drops from the right end of the second linear portion 12*b* gradually at the predetermined angle and then rises from the bottom gradually at the predetermined angle, and a third linear portion 12*c* extending from the right end of the V-shaped portion 17 by a predetermined width in the longitudinal direction on the same level with the first and second linear portions 12*a* and 12*b*.

The cam 13 has a first linear portion 13*a* formed so as to extend by a predetermined width in the longitudinal direction on the upper level of the cam plate 75 and so as to overlap by a predetermined length with the third linear portion 12*c* of the cam 12, a V-shaped portion 18 that drops from the right end of the first linear portion 13*a* gradually at the predetermined angle and then rises from the bottom gradually at the predetermined angle, a second linear portion 13*b* extending from the right end of the V-shaped portion 18 by a predetermined width in the longitudinal direction on the same level with the first linear portion 13*a*, a V-shaped portion 19 that drops from the right end of the second linear portion 13*b* gradually at the predetermined angle and then rises from the bottom gradually at the predetermined angle, and a third linear portion 13*c* extending from the right end of the V-shaped portion 19 by a predetermined width in the longitudinal direction on the same level with the linear portions 13*a* and 13*b*.

The cam 14 has a first linear portion 14*a* formed so as to extend by a predetermined width in the longitudinal direction on the lower level of the cam plate 75 and so as to overlap by a predetermined length with the third linear portion 13*c* of the cam 13, a V-shaped portion 22 that drops from the right end of the first linear portion 14*a* gradually at the predetermined angle and then rises from the bottom gradually at the predetermined angle, and a second linear portion 14*b* extending from the right end of the V-shaped portion 22 by a predetermined width in the longitudinal direction on the same level with the first linear portion 14*a*.

The punching unit 60 also has the punches 89*a* through 89*d* disposed in order in the longitudinal direction of the main frame 70 at a predetermined pitch (at intervals of a predetermined distance D3) while being supported movably in the direction orthogonal to the longitudinal direction. It is noted that even though not shown, there is provided a cam plate positioning mechanism for anchoring the cam plate 75 at predetermined positions also in the present embodiment similarly to the cam plate positioning mechanism 99 in the first embodiment.

While the movable range detecting sensor 76 comprises a light projecting element as shown in FIGS. 6 and 11, a light receiving element corresponding thereto is not shown in the figures. When the cam plate 75 moves laterally in the figure with respect to the main frame 70, dousing members 5, 6 and 7 sequentially block a light of the movable range detecting sensor 76. Then, the sensor 76 transmits a result detected at that time to the control means 80.

Based on the result of detection that the movable range detecting sensor 76 has been blocked by any one of the dousing members 5, 6 and 7, the control means 80 detects the position of the cam plate 75 moving with respect to the main frame 70 and detects that the punches 89*a* through 89*d* are kept at the highest position (non-punching position). The control means 80 also detects that the punches 89*a* through 89*d* are positioned at the lowest position (punching position), i.e., that the punching operation is being conducted, based on the result of detection that the light of the movable range detecting sensor 76 is not blocked by anyone of the dousing members 5, 6 and 7, The movable range detecting sensor 77 comprises a light projecting element 77*a* and a light receiving element 77*b* disposed so as to face to each other apart by a predetermined gap and the movable range detecting sensor 78 comprises a light projecting element 78*a* and a light receiving element 78*b* disposed so as to face to each other separated by a predetermined gap.

The light of the movable range detecting sensor 77 passes through or is blocked by a dousing plate 9 that moves between the light projecting element 77*a* and the light receiving element 77*b* when the cam plate 75 moves laterally in the figure with respect to the main frame 70 and the movable range detecting sensor 77 transmits a result detected at this time to the control means 80. Based on the result detected by the movable range detecting sensor 77, the control means 80 decides to which the cam plate 75 should be moved among the dousing member S, 6 and 7 when the cam plate 75, i.e., the punches 89*a* through 89*d*, is started again after stopping at position other than the home position, i.e., at the position where the movable range detecting sensor 76 does not face to anyone of the dousing members 5, 6 and 7, due to a power failure or the like.

The light of the movable range detecting sensor 78 passes through or is blocked by the dousing plate 9 that moves between the light projecting element 78*a* and the light receiving element 78*b* when the cam plate 75 moves laterally in the figure with respect to the main frame 70 and the movable range detecting sensor 78 transmits a result detected at this time to the control means 80. Then, based on the result detected by the movable range detecting sensor 78, the control means 80 judges whether the cam plate 75, i.e., the punches 89*a* through 89*d*, is positioned in a first movable range R4 or in a second movable range R2. The movable range detecting sensor 78 avoids the cam plate 75 from moving to the movable range of the group not used then even if an abnormality occurs in the control due to a system down such as a power failure in using the punching unit 60 for punching four or two holes by using either the first group in the first movable range R4 or the second group in the second movable range R2.

Here, the punches 89*a* through 89*d* and the cams 11 through 14 described above are arranged so as to have the following predetermined positional relationship. It is noted that pins (followers) 25, supported by the respective punches 89*a* through 89*d* as described later, slidably engage with the respective cams 11 through 14.

That is, in the initial state shown in FIG. 6 in which the cam plate 75 is positioned at the left end of the main frame 70, the pin 25 of the punch 89*a* is positioned at the right end of the second linear portion 11*b*, the pin 25 of the punch 89*b* is positioned at the right end of the third linear portion 12*c*, the pin 25 of the punch 89*c* is positioned at the right end of the third linear portion 13*c*, and the pin 25 of the punch 89*d* is positioned at the right end of the second linear portion 14*b*. Thus, all of the punches 89*a* through 89*d* are positioned at the highest position (non-punching position). In this state, the control means 80 recognizes that the cam plate 75 is in the initial state based on the position of the cam plate 75 detected by the both movable range detecting sensors 76 and 77.

Then, in the four-hole punching state, the pin 25 of the punch 89*a* is positioned in the V-shaped portion 15, the pin 25 of the punch 89*b* is positioned in the V-shaped portion 17, the pin 25 of the punch 89*c* is positioned in the V-shaped portion 19, and the pin 25 of the punch 89*d* is positioned in the V-shaped portion 22. That is, in the four-hole punching state, the cam plate 75 shifts to the first movable range R4 and lowers the punch 89*a* at the V-shaped portion 15 of the cam 11, the punch 89*b* at the V-shaped portion 17, the punch 89*c* at the V-shaped portion 19 and the punch 89*d* at the V-shaped portion 22, respectively, to the lowest position (punching position). In this state, the control means 80 recognizes the four-hole punching state based on the result detected by the movable range detecting sensors 76 and 77.

In the two-hole punching state on the other hand, the pin 25 of the punch 89*a* is positioned in the first linear portion 11*a*, the pin 25 of the punch 89*b* is positioned in the V-shaped portion 16, the pin 25 of the punch 89*c* is positioned in the V-shaped portion 18, and the pin 25 of the punch 89*d* is positioned in the first linear portion 14*a*. That is, in the two-hole punching state, the cam plate 75 shifts to the second movable range R2 and lowers the punch 89*b* at the V-shaped portion 16 of the cam 12 and the punch 89*c* at the V-shaped portion 18, respectively, to the lowest position (punching position) while keeping the punch 89*a* at the first linear portion 11*a* of the cam 11 and the punch 89*d* at the first linear portion 14*a* to the highest position, respectively. In this state, the control means 80 recognizes the two-hole punching state based on the result detected by the movable range detecting sensors 76 and 77.

In order to realize the initial state, the four-hole punching state and the two-hole punching state described above, the cams 11 through 14 have the following positional relationship to each other. That is, a pitch (D3) between the four-hole punches 89*a*, 89*b*, 89*c* and 89*d* is almost equal to a pitch between the bottoms of the corresponding V-shaped portions 15, 17, 19 and 22.

Still more, the second linear portion 11*b* of the cam 11, the third linear portion 12*c* of the cam 12, the third linear portion 13*c* of the cam 13 and the second linear portion 14*b* of the cam 14 are formed so as to become longer bit by bit in this order. Further, the second linear portion 12*b* of the cam 12 is formed to be slightly longer than the second linear portion 13*b* of the cam 13. This arrangement is made to lessen a load applied to the motor 73 in punching holes by moving the punches 89*a* through 89*d* of the first group or the punches 89*b* and 89*c* of the second group to the lowest position by shifting the timing for lowering the punches of the respective groups bit by bit.

The cams are set so that the second linear portion 11*b* of the cam 11 overlaps with the first linear portion 12*a* of the cam 12, the third linear portion 12*c* of the cam 12 overlaps with the first linear portion 13*a* of the cam 13, and the third linear portion 13*c* of the cam 13 overlaps with the first linear portion 14*a* of the cam 14.

Further, as shown in FIGS. 6 through 10, a leg 27 is attached to the lower face of the main frame 70 through an intermediary of spacers (not shown). The spacer forms a gap S1 that allows a sheet P to pass between the lower face of the main frame 70 and an upper face 27*a* of the leg 27.

As shown in FIG. 10, the main frame 70 is provided with eight upper and lower punch supporting holes 28 in total formed so as to penetrate through the upper and lower faces of the main frame 70. The punches 89*a*, 89*b*, 89*c* and 89*d* are slidably and fittingly inserted into these punch-supporting holes 28, respectively. Four dies 29 are formed on the upper face 27*a* of the leg 27 so as to face to the punch supporting holes 28 at the lower face of the main frame 70. The punches 89*a* through 89*d* are arrayed at an equal pitch (D3) and compose the first group for punching four holes and the second group for punching two holes.

Then, the punch 89*d* for example is provided with a through hole 10 perforated in the direction orthogonal to its moving direction (vertical direction in the figure). The through hole 10 supports the pin 25 so that the pin 25 penetrates through the hole 10 and the second linear portion 14*b* of the cam plate 75 and protrudes toward a guide long hole 26 formed in the vertical direction of the main frame 70. The guide long hole 26 is formed so as to penetrate through a side wall of the main frame 70 and so that its longitudinal direction orients in the vertical direction. Removable stop rings (not shown) are fitted to both ends of the pin 25.

Still more, the punch 89*d* is provided with a spring (not shown) that biases the punch 89*d* toward the corresponding die 29 and that is interposed between the upper edge of the main frame 70 and the stop ring fixed to the punch 89*d*. Although the spring biases the punch 89*d* downward, the punch 89*d* will not come out of the main frame 70 because the pin 25 penetrates through the second linear portion 14*b* of the cam 14 and is held by that. It is noted that although the structure for supporting the punch has been described here centering on that of the punch 89*d*, the structure for supporting the other punches 89*a* through 89*c* is the same as that and explanation thereof will be omitted here.

The rack 83 is linked to the left end of the cam plate 75 in FIG. 6. This will be explained with reference also to FIG. 11. The dousing plate 9 described above extending along the longitudinal direction (lateral direction in the figure) of the cam plate 75 is linked to the back of the rack 83 (on the depth side in the figure). A link plate 8 is linked to the left end of the main frame 70 by a fixing screw 3. The movable range detecting sensors 76, 77 and 78 described above are sequentially disposed on the link plate 8 at a predetermined pitch. The movable range detecting sensor 78 may be omitted by disposing a stopper 23 described later in the present embodiment.

A slide guide 4 for suppressing looseness of the rack 83 during its move is linked to an extension 70*a* of the main frame 70 extending in the left direction in the figure. The slide guide 4 is made of a synthetic resin material for example and the stopper (move restricting means) 23 described above may be provided at an adequate position of its slide groove not shown.

The stopper 23 may be formed in a body with the slide guide 4 by the same synthetic resin material and concurrently in fabricating the slide guide 4. For instance, it may be provided at the position facing to the left end of the rack 83 in the state in which the cam plate 75 is moved in the right direction in FIG. 6 to the second movable range R2.

At this time, although the cam plate 75 is capable of reciprocating within the second movable range R2 in the state in which its left side in the figure is restricted by the stopper 23, the cam plate 75 will not be switched to the first movable range R4 during its operation in the second movable range R2 even if it becomes difficult to discriminate the rotational position of the motor by the encoder 2 due to a system-down event such as a power failure and the cam plate 75 is tried to be moved to the first movable range R4 in the left direction in the figure because the stopper 23 reliably stops its move. That is, the simple arrangement using such stopper 23 allows the movable range detecting sensor 78 described above to be omitted.

As shown in FIG. 11, the dousing members 5, 6 and 7 described above are connected at the positions of the cam plate 75 in the vicinity of the rack 83 so as to be able to sequentially face to the movable range detecting sensor 76 when the cam plate 75 moves. It is noted that the position of the movable range detecting sensor 76 and the dousing members 5, 6 and 7 in the depth direction is different from that of the movable range detecting sensors 77 and 78 and the douser 9.

In the punching unit 60 of the present embodiment having the structure described above, a range to which the cam plate 75 reaches when it is moved by one step in the right direction in the figure from the home position, i.e., the initial state in FIG. 6, is the first movable range R4 and a range to which the cam plate 75 reaches when it is moved further by one step in the right direction in the figure from the neutral position, i.e., the neutral positions caused by the second linear portions 12*b* and 13*b*, is the second movable range R2.

The four-hole punching state using the four-hole punches 89*a*, 89*b*, 89*c* and 89*d* as the first group is obtained by reciprocating the cam plate 75 within the first movable range R4 and the two-hole punching state using the two-hole punches 89*b* and 89*c* as the second group is obtained by reciprocating the cam plate 75 within the second movable range R2.

For instance, when the home position is denoted as $N_1$ and the position where the punches separate from the dies 29, thus producing the non-punching state beside the home position, is defined as a neutral position, neutral positions $N_1$ and $N_2$ exist, while interposing the intermediate position where the respective punching state is produced, in order from the home position $N_1$ in the first and second movable ranges R4 and R2 sequentially provided from the home position $N_1$ in the right direction in FIG. 6. With respect to the first and second movable ranges R4 and R2 existing in one direction from the $N_1$, this state may be expressed as follows:

$$N_1 \longleftrightarrow \text{four-hole punching state (R4)} \longleftrightarrow N_2 \longleftrightarrow \text{two-hole punching state (R2)} \longleftrightarrow N_3$$

Operation in Punching Four Holes

In the initial state (initial position) of the punching unit 60 in which the motor 73 is stopped in FIG. 6, the pin 25 of the punch 89*a* is positioned in the second linear portion 11*b* of the cam 11, the pin 25 of the punch 89*b* is positioned in the third linear portion 12*c* of the cam 12, the pin 25 of the punch 89*c* is positioned in the third linear portion 13*c* of the cam 13 and the pin 25 of the punch 89*d* is positioned in the second linear portion 14*b* of the cam 14, respectively. That is, all of the punches are held at the highest positions.

When a sheet P is fed to the gap S1 and is positioned at a predetermined position in this initial state, the control means 80 turns on the punching unit 60, similarly to the case of the punching unit 30 described above. It is assumed that a user has made a setting for punching four holes in advance by this point of time.

When the motor 73 rotates so as to shift the cam plate 75 from the initial state to the four-hole punching state, the cam plate 75 starts to move in the right direction in FIG. 6 and guides the respective pins 25 of the punches 89*a* through 89*d* to the bottom of the V-shaped portions 15, 17, 19 and 22 of the corresponding cams 11 through 14, respectively. Thereby, all of the punches 89*a* through 89*d*, as the first group, drop to the lowest position, respectively, and engage with the dies 29 (see FIG. 10) after punching holes in the sheet P. At the same time, the control means 80 recognizes that four holes have been punched in the sheet P by the punches 89*a* through 89*d* of the first group based on the result detected by the movable range detecting sensors 76 and 77.

Then, because the motor 73 rotates in the same direction and the cam plate 75 moves further in the right direction within the first movable range R4, all of the punches 89*a* through 89*d* are raised to and kept at the highest position by the first linear portion 11*a*, the second linear portion 12*b*, the second linear portion 13*b* and the first linear portion 14*a*, each corresponding to the cams 11 through 14. At this time, the sheet P in which the four holes have been punched is pulled out of the gap S1 and a new sheet P is fed to the gap S1.

When the motor 73 rotates reversely by a predetermined number of revolutions in this state and when the cam plate 75 moves in the left direction in the figure, four holes are punched in the new sheet P by the four-hole punches 89*a* through 89*d*. When the cam plate 75 moves further in the left direction, the respective pins 62 of the punches 89*a* through 89*d* are led to the second linear portion 11*b*, the third linear portion 12*c*, the third linear portion 13*c* and the second linear portion 14*b*, respectively, and the cam plate 75 returns to the initial state.

Operation in Punching Two Holes

When a sheet P is fed to the gap S1 and is stopped at the predetermined position in the state in which the punches 89*a* through 89*d* are positioned at the first linear portion 11*a*, the second linear portion 12*b*, the second linear portion 13*b* and the first linear portion 14*a*, each corresponding to the cams 11 through 14, and are kept at the highest position and when the motor 73 is stopped, the control means 80 turns on the punching unit 60. It is assumed that the user has made a setting for punching two holes in advance by this point in time.

Then, when the motor 73 rotates so as to shift the cam plate 75 from the state described above to the two-hole punching state, the cam plate 75 starts to move in the right direction in FIG. 6 and the pins 25 of the punches 89*a* and 89*d* not used in punching two holes are held as they are at the highest position by the first linear portion 11*a* and the first linear portion 14*a*. In contrary to that, the pins 25 of the punches 89*b* and 89*c* which are also used in punching two holes similarly to the case of punching four holes are guided from the second linear portion 12*b* to the bottom of the V-shaped portion 16 and from the second linear portion 13*b* to the bottom of the V-shaped portion 18, respectively. Thereby, the two-hole punches 89*b* and 89*c* drop to the lowest position (punching position), respectively, and engage with the dies 29 after punching holes in the sheet P. At this time, based on the result detected by the movable range detecting means 77, the control means 80 recognizes that two holes have been made in the sheet P by the punches 89*b* and 89*c* of the second group.

Then, in response to a signal from the control means 80, the motor 73 rotates in the same direction and moves the cam plate 75 further in the right direction within the second movable range R2, so that all of the punches 89*a* through 89*d* are held at the highest position by the first linear portion 11*a*, the second linear portion 12*a*, the second linear portion 13*a* and the first linear portion 14*a* each corresponding to the cams 11 through 14. At this point in time, the sheet P in which the two holes have been punched is pulled out of the gap S1 and a new sheet P is fed to the gap S1. When the motor 73 rotates reversely by a predetermined number of revolutions in this state and when the cam plate 75 moves in the left direction in the figure, two holes are punched in the new sheet P by the two-hole punches 89*b* and 89*c*.

As described above, the punching unit 60 of the present embodiment brings about the following effects in addition to the similar effects of the first embodiment.

That is, the punching unit 60 enables the cam plate 75 to readily and reliably reach to the first movable range R4 or the second movable range R2 just by advancing the cam plate 75 in one direction by one step from the home position $N_2$ or by advancing it in the same direction further by one step from the first movable range R4. Accordingly, the control may be simplified. Still more, it is capable of vertically moving the punches 89*a* through 89*d* reliably as the first or second group just by reciprocating the cam plate 75 within the first and second movable range R4 and R2.

Still more, because the first group is composed of the four punches, i.e., an even number of punches, and the second group is composed of the two center punches 89*b* and 89*c* among the punches 89*a* through 89*d* of the first group, the four- and two-hole punching processes may be adequately and freely carried out on the sheet P (it is of course possible to punch an even number of holes of more than four) without shifting, in correspondence to each process, the center of each punching state of the four-punching state which is carried out centering on the center part of the four punches 89*a* through 89*d*, i.e., the middle position between the punches 89*b* and 89*c*, of the first group and of the two-hole punching state which is carried out centering on the middle position between the two center punches 89*b* and 89*c* of the first group.

It is also possible to omit the movable range detecting sensor 78 for detecting the move of the cam plate 75 by the very simple arrangement of just restricting the movement of the cam plate 75 to the opposite movable range by the stopper 23. That is, when the punching unit 60 is mounted to a copying machine or the like, a control is made so as to be able to use only the group actually used often based on the movable range detecting sensor 78 that detects the move the cam plate 75 to the opposite group. For instance, when the control is reset after when a supply of electric power is started again from a system-down condition such as a power failure, the control of shifting the cam plate 75 to the group used before the power failure is normally carried out based on the result detected by the movable range detecting sensor 78. Accordingly, although the movable range detecting sensor 78 is essential, the stopper 23 is capable of restricting the very movement of the cam plate 75 to the opposite side and the sensor 78 may be omitted in the present embodiment. Thereby, it becomes possible to reduce the product cost by omitting the relatively expensive sensor 78. That is, it enables to cut the cost required for a control board (not shown) in the control means 80, in addition to the cost of the movable range detecting sensor 78 itself. It also enables a considerable cost reduction to be counted on in producing several tens of thousands of sets, troubles that may be otherwise caused by the sensors and the control to be reduced and its maintenance to be reduced.

Still more, the movement of the rack 83 in the left direction in FIG. 6 may be reliably restricted at a certain position by providing the stopper 23 by blocking, with synthetic resin material, an adequate position of the slide groove of the slide guide 4 made of synthetic resin. Or, instead of that, it is possible to restrict the movement of the rack 83 in the right direction of the figure from the certain position and the same effect with that described above may be obtained by fixing a member made of an adequate material, e.g., a metallic screw, at an adequate position corresponding to the right end of the cam plate 75 in the main frame 70.

When the stopper 23 is formed in the slide groove of the slide guide 4, only the cost for correcting a die of the slide guide 4 needs to be taken into account and hence it may be handled at very low cost without increasing the cost.

It may be needless to say that the arrangement of eliminating the movable range detecting sensor 78 by providing the stopper 23 is also applicable to the first embodiment described above.

INDUSTRIAL APPLICABILITY

As described above, the inventive punching unit is useful mounted to a main body of an image forming apparatus such as a copying machine, a printer, a facsimile and a multifunction machine of those machines or to a printing machine, and is specifically suitable for an apparatus which is required to be simplified by reducing a number of parts.

The invention claimed is:

1. A punching unit comprising:

a plurality of punches and dies for punching holes in a sheet member to be punched, said punches being movable in a moving direction;

a reciprocating member capable of reciprocating in a reciprocating direction orthogonal to the moving direction of said punches;

a plurality of cams and cam followers that are operably interposed between said reciprocating member and said plurality of punches so that reciprocating movement of said reciprocating member converts to movement of said punches in the moving direction between punching and non-punching positions;

wherein said plurality of punches are grouped into a first group of punches that is composed of a predetermined number of punches and a second group of punches that includes one of said punches of said first group and that has a smaller number of punches than said predetermined number of punches of said first group;

wherein said plurality of cams and cam followers include cams and cam followers corresponding to said first group of punches that are arranged to produce a predetermined number of holes in a punching state by moving said punches of said first group in the moving direction in response to reciprocation of said reciprocating member within a first movable range;

wherein said plurality of cams and cam followers include cams and cam followers corresponding to said second group of punches that are arranged to produce a punching state for a smaller number of punches than the predetermined number of punches by moving said punches of said second group in the moving direction in response to reciprocation of said reciprocating member within a second movable range;

wherein said plurality of cams are each formed in said reciprocating member extending in the reciprocating direction, have at least one V-shaped portion for moving one of said punches from said non-punching position to said punching position and back to said non-punching position, and have straight sections connecting with said at least one V-shaped portion that hold the one of said punches at said non-punching position;

wherein at least one of said cams is exclusively used with said first group or said second group, and said at least one of said cams that is exclusively used engages said cam follower with said V-shaped portion thereof when producing said punching state of said first movable range or said second movable range, and engages said cam follower continuously with said straight portion across its entire range when not producing said punching state of said first movable range or second movable range;

wherein said cam that corresponds to said punches of said one of said first group that is also included in said second group has a first said V-shaped portion that engages with said cam follower in said first movable range and a second said V-shaped portion that engages with said cam follower in said second movable range; and wherein said first movable range is a range in which said reciprocating member has moved when it has advanced by one step in one direction of reciprocation from a home position with respect to a main frame that supports said reciprocating member and said second movable range is a range in which said reciprocating member has moved when it has advanced by another step in said one direction of reciprocation.

2. The punching unit of claim 1, wherein:

first and second neutral positions are provided on opposite sides from said home position in said first and second movable ranges, respectively, said home position being interposed between said first and second neutral positions; and said reciprocating member moves said first group of said plurality of punches or said second group of said plurality of punches in the moving direction by reciprocating in said first movable range or said second movable range.

3. The punching unit of claim 1, wherein said first group comprises three or more of said punches arrayed at a predetermined pitch, and said second group comprises at least two punches of said punches of said first group.

4. The punching unit of claim 1, further comprising movement restricting means for restricting said reciprocating member from moving in the second movable range or the first movable range when being used in the first movable range or the second movable range, respectively.

5. The punching unit of claim 4, wherein said movement restricting means comprises a stopper for blocking movement of said reciprocating member at a predetermined position with respect to said main frame.

* * * * *